United States Patent [19]

Alexis, Jr.

[11] 4,216,696

[45] Aug. 12, 1980

[54] CYMBAL STAND AND ASSEMBLY

[76] Inventor: Raoul H. Alexis, Jr., 401 Cedar St., Vallejo, Calif. 94590

[21] Appl. No.: 38,114

[22] Filed: May 11, 1979

[51] Int. Cl.[3] ..... G10D 13/06

[52] U.S. Cl. ..... 84/422 R

[58] Field of Search ..... 84/422, 421

[56] References Cited

U.S. PATENT DOCUMENTS

| | | | |
|---|---|---|---|
| 647,954 | 4/1900 | Flemming | 84/422 R |
| 774,539 | 11/1904 | Stanton | 84/422 C |
| 922,706 | 5/1909 | Ludwig | 84/422 C |
| 1,092,276 | 4/1914 | Ludwig | 84/422 C |

*Primary Examiner*—Lawrence R. Franklin

*Attorney, Agent, or Firm*—Willis E. Higgins

[57] ABSTRACT

A foot operated cymbal assembly includes a cymbal stand with a cymbal mounted near its top. A first foot pedal is positioned near the bottom of the stand. A beater operated by the first foot pedal is positioned on the stand to strike the cymbal. A second foot pedal is positioned near the bottom of the stand. A cymbal vibration damper is positioned on the stand for selective engagement with the cymbal by operation of the second foot pedal. In preferred form of the invention, the foot pedals are positioned to be actuable by the same foot. This stand and cymbal assembly allows a single percussionist to produce a substantially more complex pattern of sounds using a cymbal than possible with the prior art.

10 Claims, 2 Drawing Figures

CYMBAL STAND AND ASSEMBLY

BACKGROUND OF THE INVENTION

1. Field of the Invention

This invention relates to a cymbal stand and foot pedal assembly for producing and dampening percussion sounds with the cymbal. More particularly, it relates to such a stand and assembly which will allow a single percussionist to produce more complex patterns of percussion sounds from a cymbal than has been possible with prior art cymbal stands. Most especially, it relates to such a cymbal stand and assembly which will allow a percussionist to produce patterns of percussion sounds using a cymbal hitherto possible only with more than one percussionist playing together.

2. Description of the Prior Art

It has long been recognized that a foot pedal can be employed to strike a drum, cymbal or similar percussion instrument and to dampen the vibrations produced by such striking. An example of a foot pedal operated apparatus for both striking and dampening percussion instruments is disclosed in, for example, U.S. Pat. No. 647,954. However, in the apparatus disclosed there, both the striking and the dampening are carried out through use of a single foot pedal, and the striking and dampening mechanisms are not independently actuable. Similar teachings are found in, for example, U.S. Pat. Nos. 774,539; 922,706; 1,092,276; and 1,277,123.

Canadian Pat. No. 983,298 discloses separate beaters for a drum, cymbal or similar percussion instrument, each actuated by a foot pedal. U.S. Pat. No. 3,951,032 discloses a foot pedal operated dampener for a timpano drum.

While a variety of approaches for both striking and dampening the vibrations of a percussion instrument by means of a foot pedal are disclosed in the prior art, the prior art arrangements are limited in the different types of sounds that can be produced and controlled using them.

SUMMARY OF THE INVENTION

Accodingly, it is an object of this invention to increase the complexity of percussion effects that can be produced by a single cymbal player.

It is another object of the invention to provide apparatus allowing a cymbal to be independently struck and dampened under control of a single foot.

It is a still further object of the invention to provide a cymbal stand which will permit a lead percussionist to produce certain additional sounds while playing the lead part of a musical composition, which additional sounds are normally provided by an accompanying percussionist.

It is yet another object of the invention to allow a lead percussionist to play the lead and produce a sound similar to that produced by a wave breaking on shore.

It is a still further object of the invention to allow a cymbal player to produce certain sounds with the cymbal while producing ride and crest sounds in a conventional manner at the same time.

The attainment of these and related objects may be achieved through use of the cymbal stand and actuation assembly and cymbal assembly herein disclosed. A cymbal stand and actuation assembly in accordance with the invention includes a cymbal stand with a holder for a cymbal mounted on the stand. A beater is positioned to strike the cymbal when the cymbal is mounted on the stand. A first foot pedal is operatively coupled to the beater. A damper is positioned on the stand for selective engagement of the cymbal when mounted on the stand. The second foot pedal is operatively coupled to the damper. It is preferred that the first and second foot pedals be coupled to the beater and damper, respectively, by means of linkages with adjustable length. The first and second foot pedals are also preferably positioned for selective operation by the same foot of a user.

A cymbal mounted on the stand and actuation assembly of this invention can be played by means of the foot pedals independently of other techniques employed to play the cymbal. The invention therefore allows greater variation in the percussion effects than can be produced by a single percussion player playing the cymbal in a conventional manner with sticks, mallets and the like and hand dampening. The result is to allow certain sound patterns previously unplayable except by more than one percussionist to be played by a single percussionist.

The attainment of the foregoing and related objects, advantages and features of the invention should be more readily apparent after review of the following more detailed description of the invention, taken together with the drawings, in which:

DETAILED DESCRIPTION OF THE INVENTION

Figure 1:
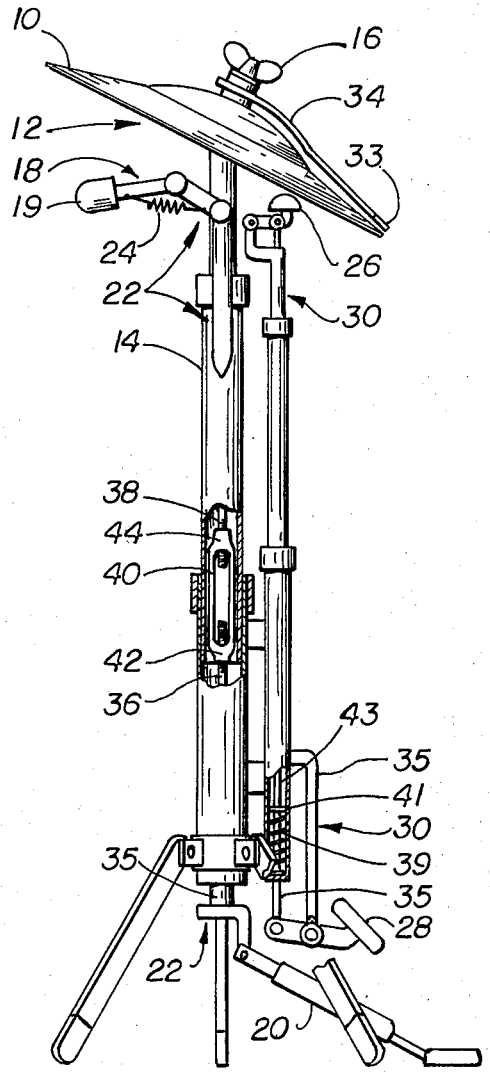
FIG. 1 is a side view of a cymbal stand and actuation assembly in accordance with the invention, including a cymbal in place on the stand with cutways to show detail.
Figure 2:
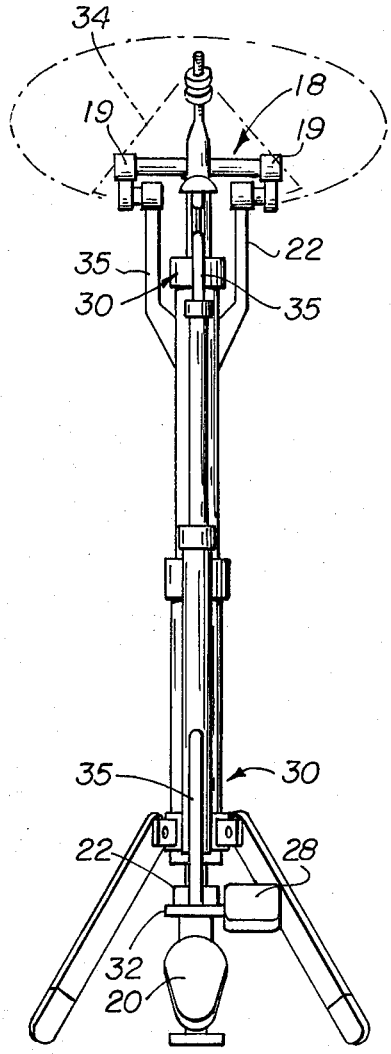
FIG. 2 is a front view of the cymbal stand and actuation assembly of FIG. 1, but with the cymbal shown in phantom.

Turning now to the drawings, more particularly to FIGS. 1 and 2, a cymbal stand and actuation assembly in accordance with the invention with a cymbal 10 in place is shown. Cymbal 10 is mounted at the top 12 of stand 14 through an aperture in its center by means of wing nut 16 in a conventional manner. A striker 18 is mounted near the top 12 of the stand 14 to strike cymbal 10 when the striker is actuated. The striker 18 has heads 19 which induce vibrations in cymbal 10 when it strikes the cymbal. The heads 19 can have different degrees of hardness or softness to produce different sounds depending on the desires of a musician using the apparatus. For example, materials ranging from a soft felt to a hard rubber may be employed.

A first foot pedal 20 is mounted on the bottom of the stand 14. It is connected to the striker 18 by means of linkage 22. The linkage 22 is preferably spring loaded, as shown at 24, to bias the striker 18 away from cymbal 10 when first foot pedal 20 is not depresssed.

A hemispherical shaped rubber or similar resilient material damper 26 is similarly mounted underneath cymbal 10 on the stand 14. A second foot pedal 28 is mounted near the first foot pedal 20 at the bottom of stand 14. A linkage 30 connects the second foot pedal 28 and damper 26. A clear bar 32 forming a part of linkage 30 serves to position second foot pedal 28 to one side of the first foot pedal 20. Foot pedal 28 may be provided on the other side of first foot pedal 20 than that shown, or a pair of foot pedals 28 may be provided, one on each side of first foot pedal 20 on each end of the clear bar 32. A top damper 34 is positioned on the other side of cymbal 10 and opposite damper 26. A rubber or similar resilient material tip 33 is provided on top damper 34 where cymbal 10 engages top damper 34 when damper 26 pushes against the cymbal 10.

While the linkages 22 and 30 may take any suitable form, they preferably comprise a group of pivotally interconnected rigid rods 35. However, if desired a flexible cable linkage could also be employed. In order to keep pedal 28 in the proper position for actuation as shown when it is not being depressed, a spring 39 is provided at the bottom of linkage 30. A plate 41 is fixedly mounted on rod 43 forming a part of the linkage. When the pedal 28 is released after using the damper 26, the plate 41 is lowered until it rests on the spring 39, thus limiting further movement of the pedal 28.

In operation, depressing first foot pedal 20 causes linkage 22 to pivot head 19 of striker 8 against cymbal 10 to produce vibrations in it. Since striker 18 is spring loaded, it will move away from cymbal 10 when the first foot pedal 20 is released. The amount of loading on springs 24 may be varied to alter the feel of first foot pedal 20 when it is actuated.

In a similar manner, depression of second foot pedal 28 serves to move damper 26 upward by actuation of linkage 30 until cymbal 10 is biased against top damper 34 to dampen vibrations induced in cymbal 10. Linkage 30 is desirably not spring loaded, but relies on the force of gravity to move damper 26 away from cymbal 10 when second foot pedal 28 is released.

FIG. 1 shows detail of the linkages 30 and 22, which makes them adjustable to length. Each linkage has a lower screw threaded rod 36 and an upper screw threaded rod 38. Connecting member 40 is screw threaded at each end 42 and 44. The lower rod 36 and the upper rod 38 are screwed into ends 42 and 44, respectively, a greater or lesser extent to adjust the length of linkages 22 and 30. In this manner, the cymbal stand and actuating assembly may be adjusted to different heights for different users and to project sound from the cymbal differently with respect to drums and other percussion instruments forming an ensemble, depending on the type of music being played and the effect desired by the percussionist.

It should now be apparent that a cymbal stand and actuating assembly capable of achieving the stated objects of the invention has been provided. A cymbal may be both struck and dampened independently, but employing the same foot with two foot pedals connected by separate linkages to a striker and a damper for a cymbal. Operation in this manner leaves the two hands and other foot of the percussionist free to produce other sounds from the cymbal or from other percussion instruments, while utilizing the two foot pedals to produce a sound similar to that produced by a wave breaking on shore. The result is a material increase in the complexity of sound paterns that can be produced by a single percussionist.

While the invention has been shown with reference to a preferred embodiment of it, it should be apparent to those skilled in the art that various changes in form and detail of the invention may be made. It is intended that such changes be included within the spirit and scope of the claims appended hereto.

What is claimed is:

1. A foot operated cymbal assembly, which comprises:

(a) a cymbal stand, (b) a cymbal mounted proximate to the top of said stand, (c) a first foot pedal positioned proximate to the bottom of said stand, (d) a beater positioned on said stand to strike said cymbal, (e) a linkage operatively connecting said first foot pedal and said beater, (f) a second foot pedal positioned proximate to the bottom of said stand, (g) a cymbal vibration damper positioned on said stand for selective engagement with said cymbal, and (h) a linkage operatively connecting said second foot pedal and said cymbal vibration damper.

2. The foot operated cymbal assembly of claim 1 in which said linkage operately connected said first foot pedal and said beater is spring loaded to bias said beater away from said cymbal when said first foot pedal is unactivated.

3. The foot operated cymbal assembly of claim 1 in which said cymbal vibration damper is positioned on one side of said cymbal and a second vibration damping member is positioned on the other side of said cymbal and opposite to said cymbal vibration damper.

4. The foot operated cymbal assembly of claim 3 in which said cymbal vibration damper includes an at least substantially hemispherical shaped resilient member positioned to engage said cymbal when said second foot pedal is activated.

5. The foot operated cymbal assembly of claim 1 in which said first and second foot pedals are positioned to be activated by the same foot.

6. The foot operated cymbal assembly of claim 1 in which said first and second foot pedals are mounted on said stand.

7. The foot operated cymbal assembly of claim 1 in which the linkages joining said first foot pedal and said beater and said second foot pedal and said cymbal vibration damper are of adjustable length.

8. A cymbal stand and activation assembly, which comprises:

(a) cymbal stand including a holder for a cymbal mounted on said stand, (b) a beater positioned to strike the cymbal when mounted on said stand, (c) a first foot pedal operatively coupled to said beater, (d) a damper positioned on said stand for selective engagement of the symbal when mounted on said stand, and (e) a second foot pedal operatively coupled to said damper.

9. The cymbal stand and actuation assembly of claim 8 in which said first and second foot pedals are positioned for selective operation by the same foot of a user.

10. The cymbal stand and actuation assembly of claim 8 in which said beater is spring loaded to bias said beater away from the cymbal when mounted on said stand and said foot pedal is not in operation.

* * * * *